US007325582B2

(12) United States Patent
Smythe et al.

(10) Patent No.: US 7,325,582 B2
(45) Date of Patent: Feb. 5, 2008

(54) DRYWALL BAZOOKA FOR APPLICATION OF FLEXIBLE CORNER BEAD

(75) Inventors: Timothy Smythe, Bend, OR (US); Douglas Wambaugh, Bend, OR (US)

(73) Assignee: Timothy Smythe, Jr., Bend, OR (US)

( * ) Notice: Subject to any disclaimer, the term of this patent is extended or adjusted under 35 U.S.C. 154(b) by 464 days.

(21) Appl. No.: 10/933,150

(22) Filed: Sep. 2, 2004

(65) Prior Publication Data

US 2005/0055981 A1 Mar. 17, 2005

Related U.S. Application Data

(60) Provisional application No. 60/499,798, filed on Sep. 3, 2003.

(51) Int. Cl.
*B32B 37/10* (2006.01)

(52) U.S. Cl. ..... 156/527; 156/577; 156/579

(58) Field of Classification Search ..... 156/71, 156/527, 574, 577, 579
See application file for complete search history.

(56) References Cited

U.S. PATENT DOCUMENTS

| | | | | |
|---|---|---|---|---|
| 2,929,089 | A * | 3/1960 | Nall | 15/230.11 |
| 3,540,104 | A * | 11/1970 | Duffy | 492/13 |
| 4,086,121 | A | 4/1978 | Ames | 156/526 |
| 4,196,028 | A * | 4/1980 | Mills et al. | 156/71 |
| 4,197,624 | A * | 4/1980 | Lass | 156/579 |
| 4,358,337 | A * | 11/1982 | Johnson et al. | 156/526 |
| 4,406,730 | A * | 9/1983 | Altmix | 156/574 |
| 4,707,202 | A * | 11/1987 | Sweeny | 156/71 |
| 4,750,968 | A * | 6/1988 | Sweeny | 156/523 |
| 4,828,647 | A | 5/1989 | Eccleston | 156/526 |
| 6,413,606 | B1 * | 7/2002 | Calderon | 428/61 |
| 6,513,562 | B1 | 2/2003 | Trout | 156/391 |
| 6,540,002 | B1 * | 4/2003 | Edwards et al. | 156/577 |
| 6,907,908 | B1 * | 6/2005 | Weldy | 141/67 |
| 2006/0219366 | A1 * | 10/2006 | Smythe et al. | 156/574 |

FOREIGN PATENT DOCUMENTS

GB 2346406 A * 8/2000

* cited by examiner

*Primary Examiner*—Mark A Osele
(74) *Attorney, Agent, or Firm*—Clifford Kraft

(57) ABSTRACT

A drywall tool for dispensing flexible trim material such as FLEXTRIM and ULTRALITE products, or any other flexible trim material, containing a head attached to an elongated handle, a drive wheel attached to the head for pulling the trim material from a roll, at least one roller for pressing the trim material into an interior or exterior corner and a cutter for cutting the trim material. A pair of rollers can be attached to a ferris wheel assembly to be swung into position for interior or exterior corners. The interior roller can resemble a pizza knife, and the exterior roller can be cylindrical of varying diameter shaped like two intersecting cones.

20 Claims, 9 Drawing Sheets

DRYWALL BAZOOKA FOR APPLICATION OF FLEXIBLE CORNER BEAD

This application is related to and claims priority from U.S. Provisional patent application No. 60/499,798 filed Sep. 3, 2003. Application 60/499,798 is hereby incorporated by reference.

BACKGROUND

1. Field of the Invention

The present invention relates generally to the field of drywall corner bead application and more particularly to a drywall tool that applies flexible corner bead.

2. Description of the Prior Art

It is well known in the field of drywall installation to use a device called a BAZOOKA® to string drywall tape to seams. This tool is a combination drywall mud and tape dispenser that is attached to a long handle. The tool is filled with drywall mud and a roll of drywall tape. The device applies drywall tape along flat seams simply running the device along the seam.

Drywall corners, both exterior and interior, on the other hand, are usually finished with drywall corner beads. This process has been done by hand in the past by either nailing the bead in place and then mudding it, or by mudding and pressing the bead in place. Most corner beads must be sanded after the applied mud is dry. An example of a bead that does not require sanding is a family of products called FLEXTRIM® and ULTRAFLEX® sold by Drywall Systems International, Inc. This product can simply be applied onto wet mud, pressed into position, and finally have the tapered edges feathered with a small amount of mud and a drywall knife. The outer surface of the trim is prepared to directly receive paint or texture as soon as the mud dries. No sanding, or very little sanding, is necessary.

What is badly needed is a similar type device that can dispense a flexible corner bead onto an exterior or interior corner.

SUMMARY OF THE INVENTION

The present invention relates to a drywall tool for dispensing flextrim bead for both interior and exterior angles. The tool can contain a base mounting member with an elongated handle, a head member attached to the base member with the head member containing a drive wheel for pulling flextrim product from a roll and feeding it onto a drywall corner seam and at least one blade wheel also attached to the head member where the blade wheel presses the flextrim product into the seam and the blade wheel can be a disk like a pizza blade for an interior seam or a pair of conical members for an exterior corner.

The blade wheel for an exterior corner can be made with pair of cones intersecting along a central axis and aligned along the axis. The blade wheels can be attached to a ferris wheel arrangement that is in turn attached to the head, where the ferris wheel arrangement holds the interior blade wheel on one end and the exterior blade wheel on the other end. This allows the ferris wheel to be used to rotate one of said blade wheels into position for use. It is also possible to have removable drive wheels where they can be interchanged for different types of trim product.

The tool of the present invention can also have a cutter attached to the head member for cutting the flextrim product. The cutter can be powered, spring-loaded or manual, or can be any other type of cutter capable of cutting the flextrim.

It should be noted that various figures and illustrations have been presented to aid in the understanding of the present invention. The scope of the present invention is not limited to the embodiments shown in the figures.

DESCRIPTION OF THE INVENTION

Figure 1:
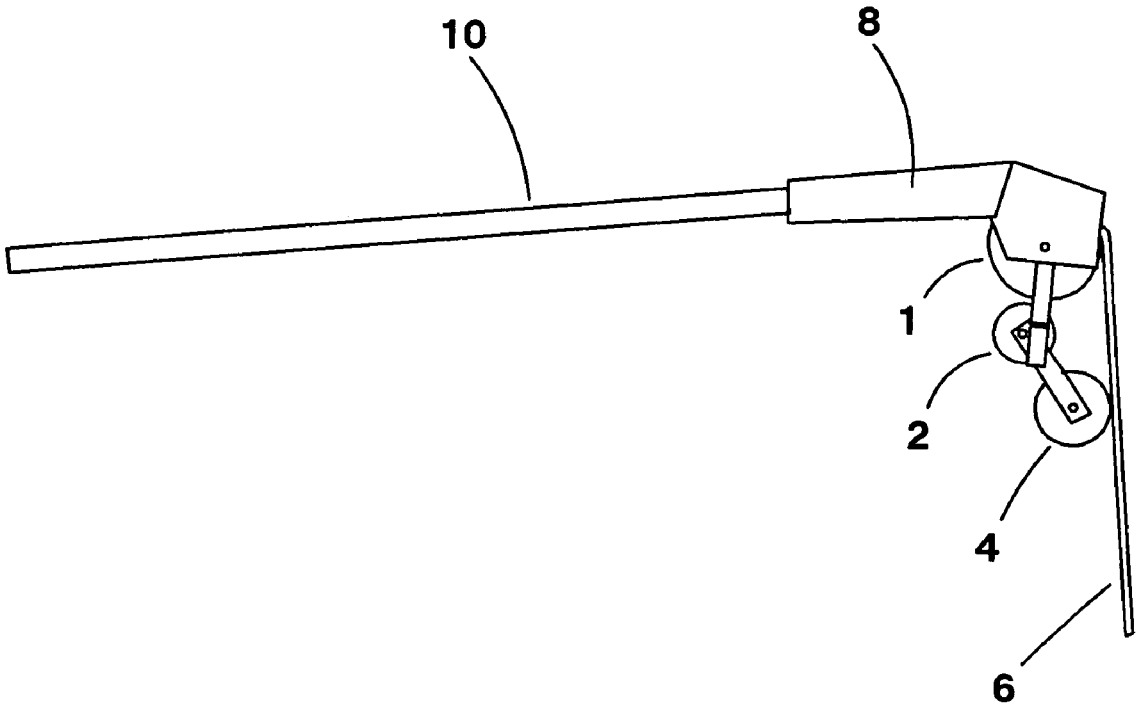
FIG. 1 shows a side-on view of an embodiment of the invention.

Turning to FIG. 1, an embodiment of the present invention is shown that includes a long handle 10, a head 8, a ferris wheel arrangement with two roller blade wheels: an interior roller 2 and an exterior roller 4. A strip of flexible trim material 6 is shown passing through the device.

Figure 5:
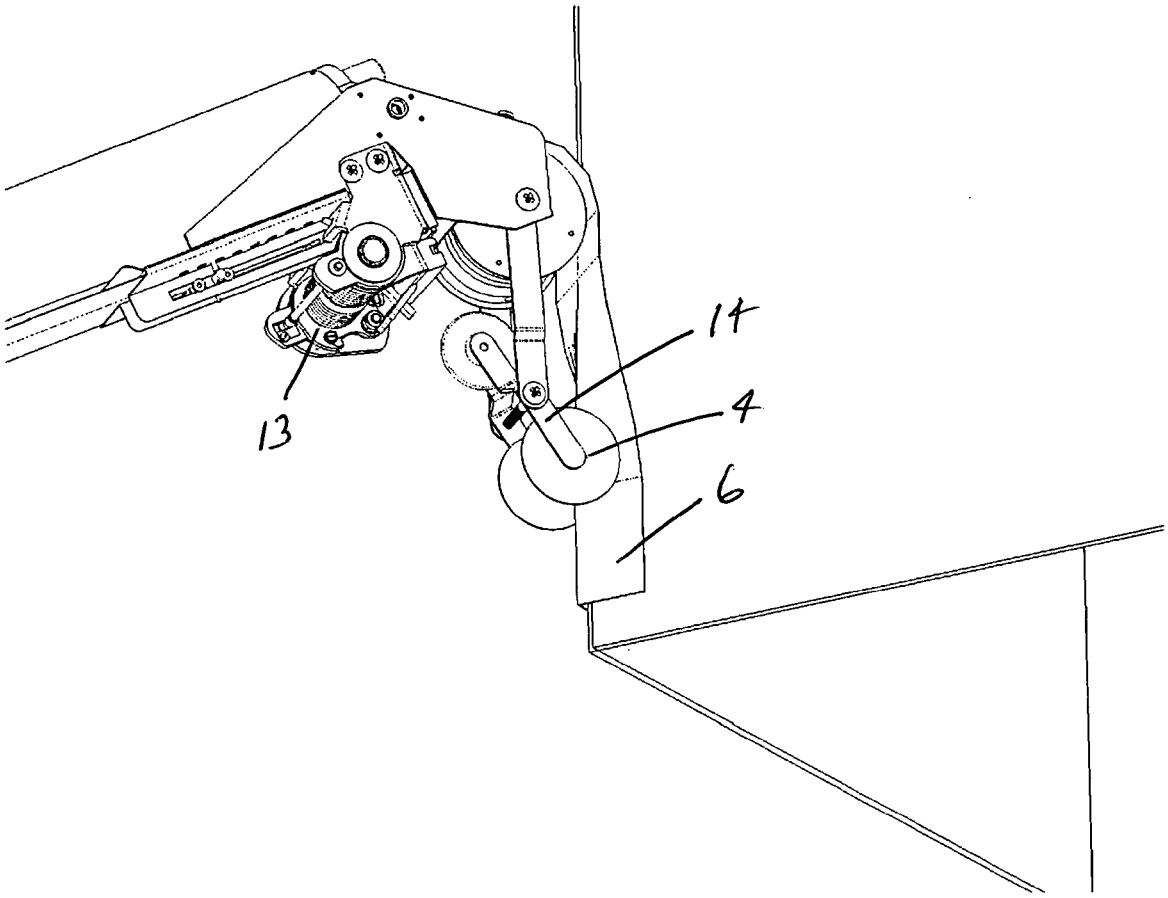
FIG. 5 shows an embodiment of the invention being used to lay exterior flex trim.
Figure 6:
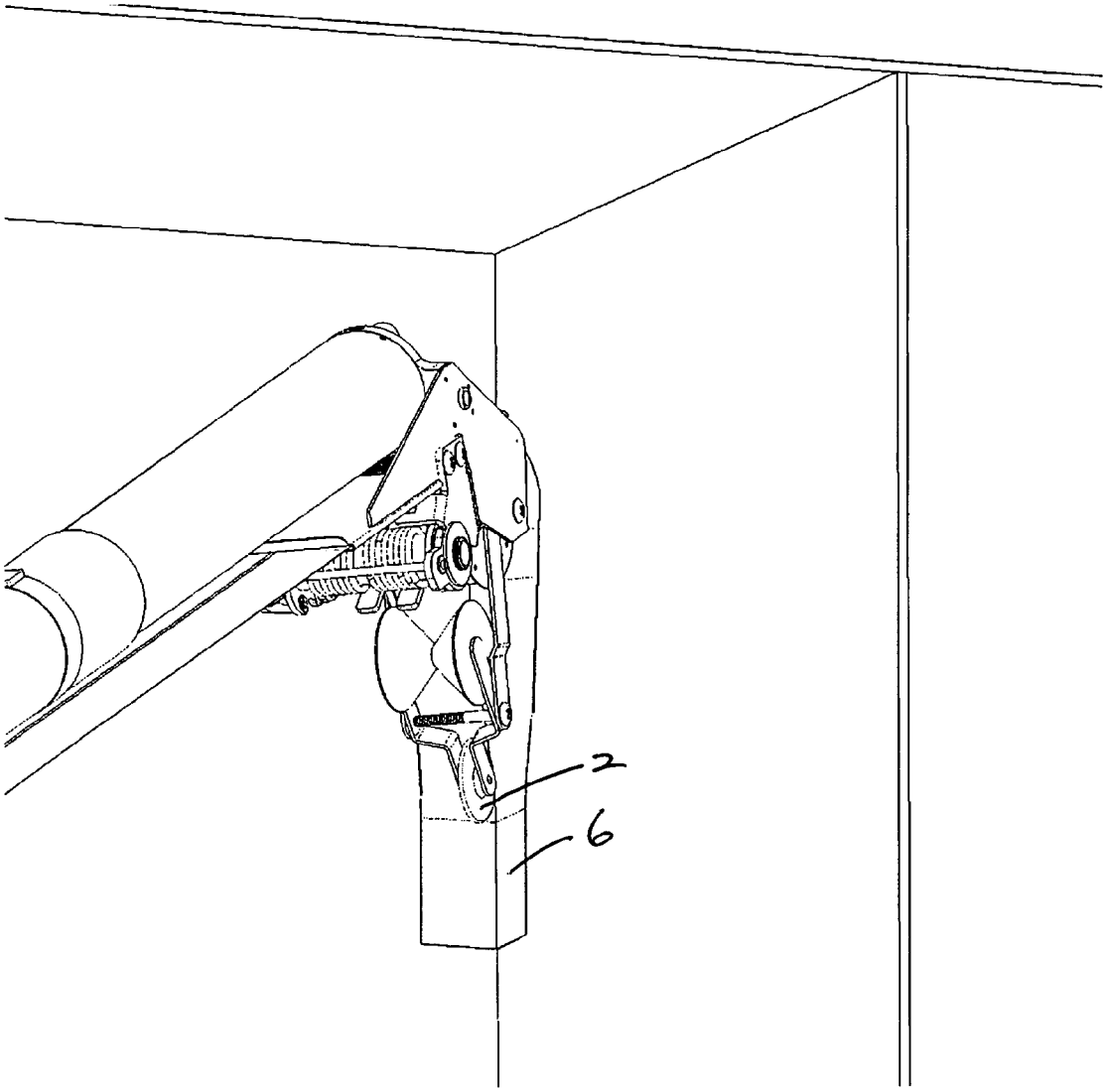
FIG. 6 shows an embodiment of the invention being used to lay interior flex trim.

The operation of the embodiment of FIG. 1 can be seen FIGS. 5-6. FIG. 5 shows the tool of the present invention laying down a strip of exterior drywall flexible trim 6. The ferris wheel double head 14 is set so that a conical blade wheel 4 fits the drywall flextrim 6 to the corner. FIG. 6 shows the same operation on an interior corner with a piece of interior flextrim 6. Here the interior roller blade wheel 2 presses the flextrim into the corner. The interior blade wheel can resemble a pizza cutter.

Returning to FIG. 1, a technician can hold the tool by the long handle 10 and move it down the seam. The flextrim 6 feeds off of a roll and can be cut when needed. Mud can optionally be applied by the present invention or the seam can be pre-mudded. The preferred method is to have the tool deliver the mud. When the end of the run is reached, the trim can be cut by any type of cutter. FIG. 5 shows a spring-loaded cutter 13 attached to the head 8. Any type of cutter is within the scope of the present invention.

Figure 2:
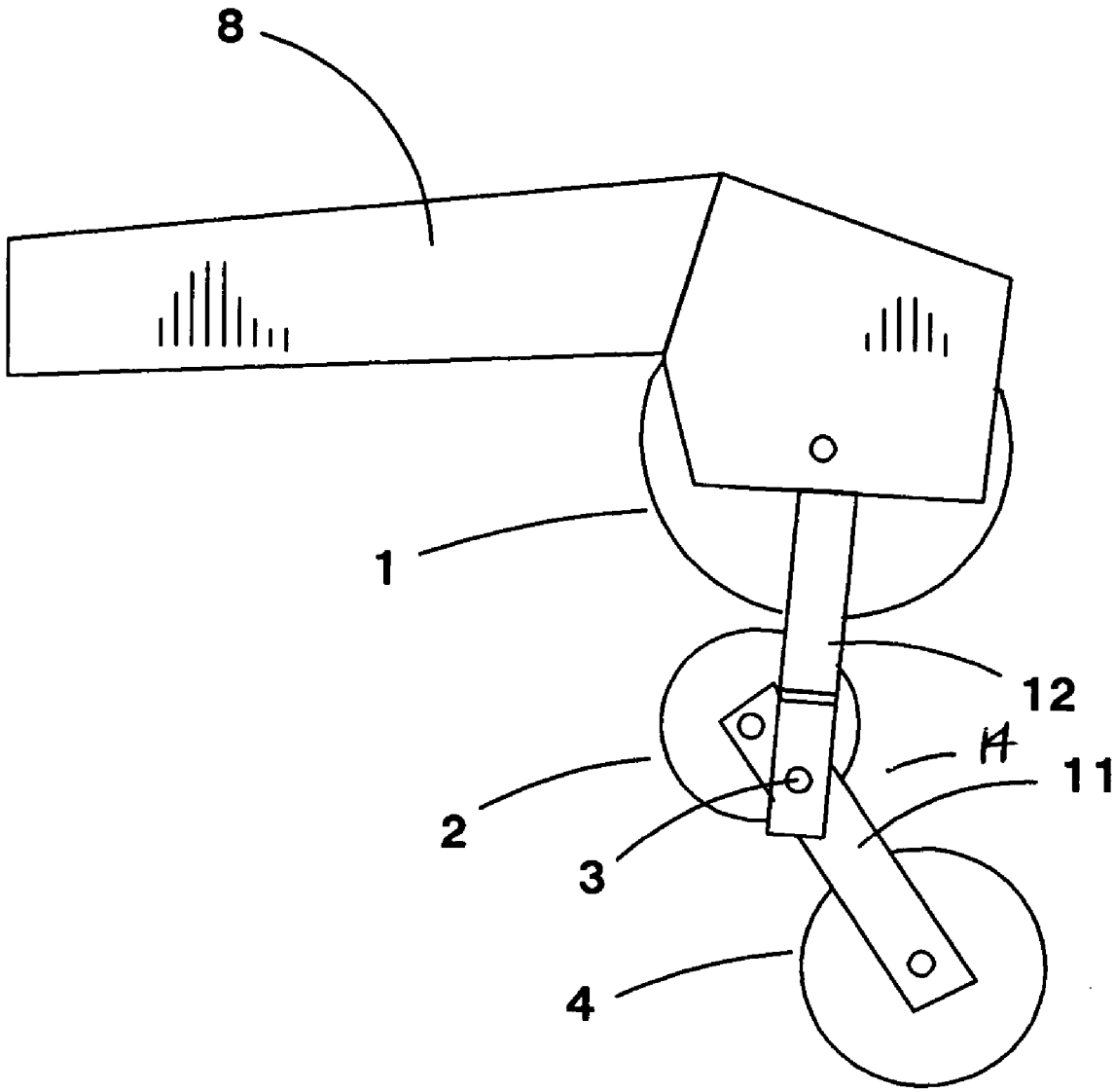
FIG. 2 shows an embodiment of a head.

FIG. 2 shows a detail of the head 8 and the attached wheels. A larger feed wheel 1 causes the rolled flextrim to feed off the roll and into the seam. The flextrim passes above the large feed wheel 1 in FIG. 2. A ferris wheel arrangement 14 includes a shaft 11 that pivots on a bolt or rod 3 and is loaded with a roller blade wheel at each end. The first end holds an interior seam blade wheel 2; the second end holds an exterior seam blade wheel 4.

An alternative to a ferris wheel arrangement is direct replacement of one blade wheel by another for the correct type of corner.

Because the nature of flextrim is very different from drywall tape, the blade wheels of the present invention are unique. Normally flextrim is made of high impact plastic, while drywall tape is usually paper. As can be seen in FIGS.

5-6, the flexible trim material or bead is dispensed in a manner similar to drywall tape in a conventional dispensing tool.

Figure 3:
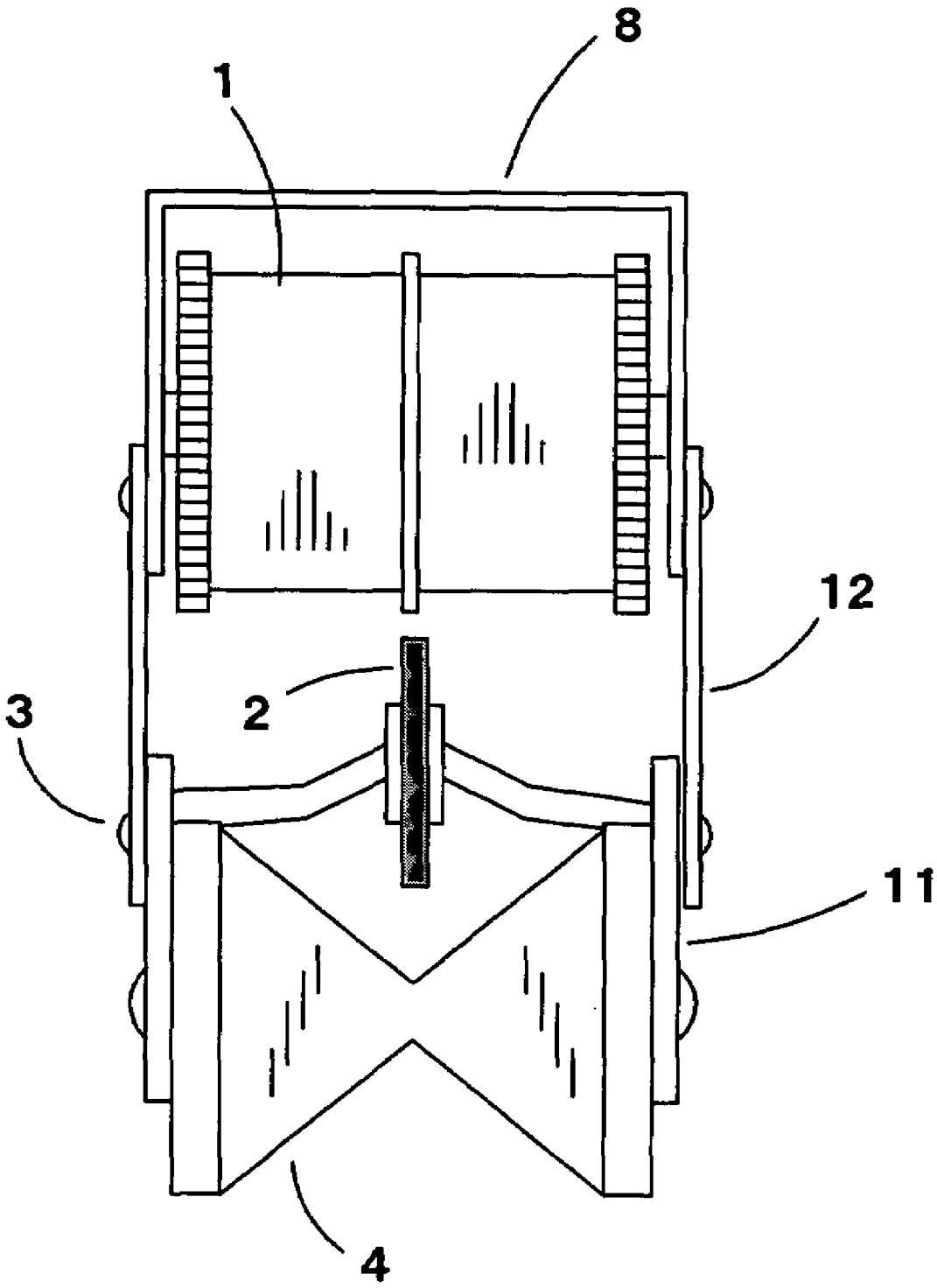
FIG. 3 shows a front looking view of the head of FIG. 2.

FIG. 3 shows a front-on view of the roller blade wheels and the drive wheel 1. The flextrim is pulled off of a roll and fed by the drive wheel 1 which is held in the head housing 8. The drive wheel 1 can have teeth on its outside edges as shown in FIG. 3 to pull the flextrim product from the roll and drive it into the seam. In some embodiments of the present invention, the drive wheel 1 can be removable and changed out for different types of flextrim products.

A lower part of the structure 12 shown in FIG. 3 can be attached to a pivot point 3 which can be a bolt or rod. This pivot point 3 can define the ferris wheel arrangement. The interior blade wheel 2 and the exterior blade wheel 4 (rollers) can be seen sideways in FIG. 3.

Figure 4A:
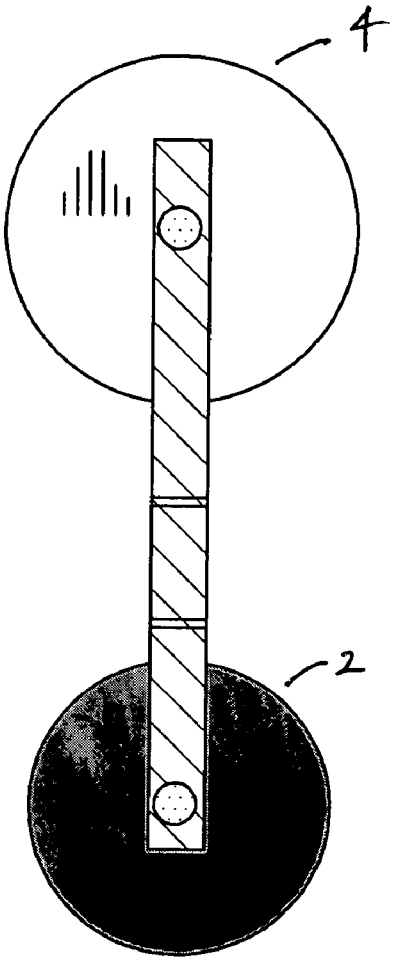
FIG. 4A shows a side view of the interior/exterior ferris wheel.
Figure 4B:
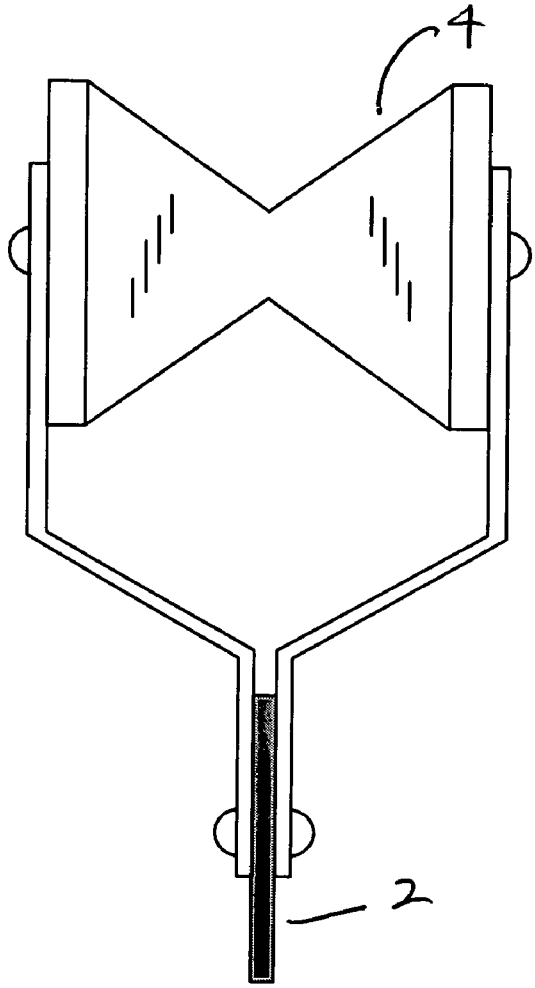
FIG. 4B shows a front view of the ferris wheel of FIG. 4A.

FIG. 4A shows a side view of the ferris wheel arrangement, while FIG. 4B shows a front view. Both roller blade wheels are round; however, the interior wheel 2 is narrow in order to force the flextrim into an interior corner. The exterior wheel 4 is generally wide and can be formed from the intersection of two cones. The unique shapes of the rollers cause them to exactly fit the seam they are being used for. In particular, the continuously linearly changing diameter from center to outside causes the tool to exactly fit the shape of an exterior corner. The blade wheels 2,4 are preferably made from aluminum; however, any solid material can be used including steel and plastic. The blade wheels can be made any convenient dimensions and the exterior blade wheel 4 can have any convenient slope. The preferred slope is around 46 degrees since a standard exterior corner is around 90 degrees. The preferred diameter of the exterior blade wheel 4 is around 2 inches, while the preferred diameter of the interior blade wheel 2 is slightly smaller. In general, the angle of the exterior blade wheel 4 should be chosen to match that of the wall.

It should be noted that the ferris wheel arrangement is optional, and that blade wheels can be made removable in various embodiments of the present invention. In this case, blade wheels can be chosen to match particular job requirements. In particular, blade wheels can be used that match any interior or exterior angle.

The tool of the present invention can optionally contain a lever to make the device move out from a wall.

It should be noted that the flextrim material or flexible bead can be made any width with a preferred width of around 3¼ inches for outside corners. Different blade wheels can be used for trim of different widths.

As previously stated, FIG. 5 shows an embodiment of the present invention being used to lay down an exterior corner. FIG. 6 shows the same embodiment being used to lay down an interior corner.

Figure 7:
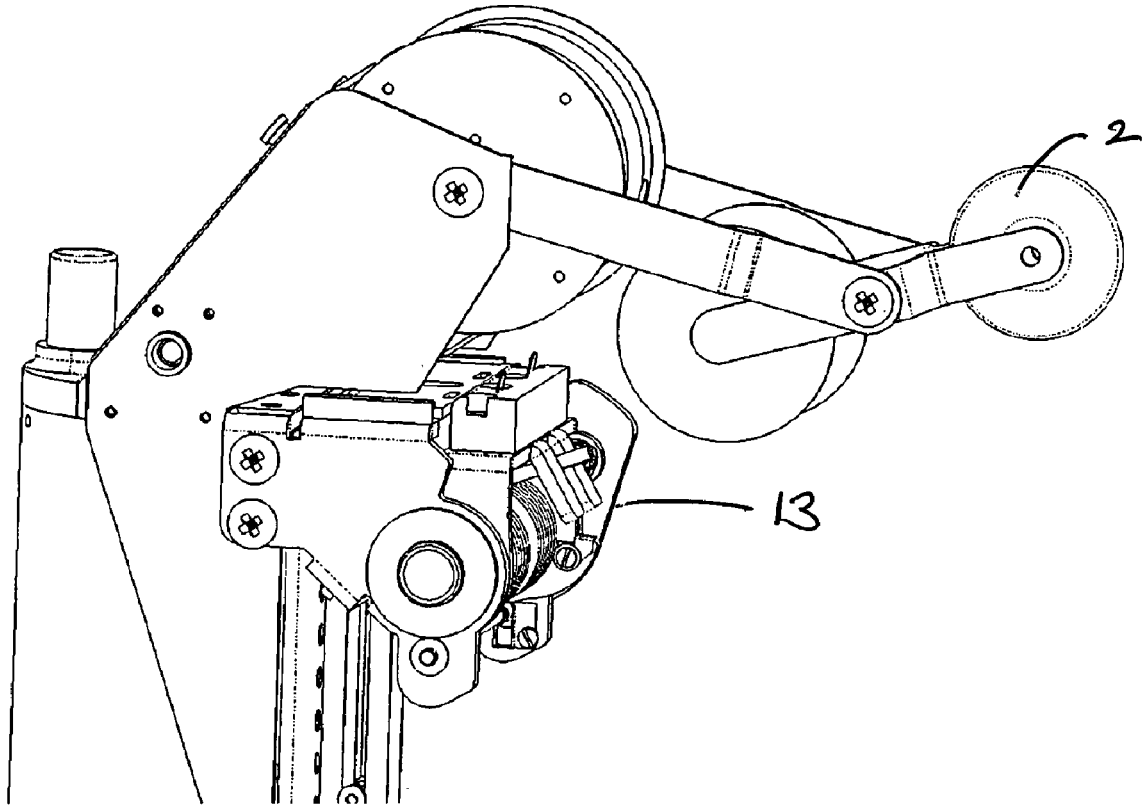
FIG. 7 shows an embodiment of a head with a spring-loaded cutter and the ferris wheel in position for an interior corner.
Figure 9:
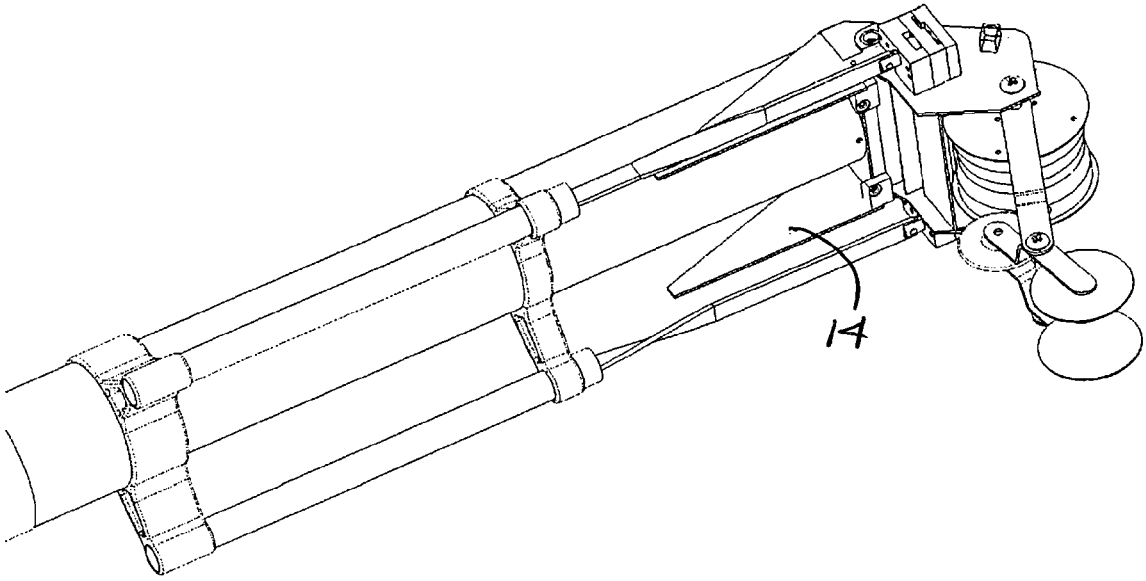
FIG. 9 shows an embodiment of a head with a manual cutter.

FIG. 7 shows a side perspective view of a slightly different embodiment. Most of the features previously described can be seen. In addition, a cutter 13 is shown which can be used to cut the trim. The cutter 13 shown in FIG. 7 is a spring-loaded cutter that can be activated with a trigger. Any type of cutter is within the scope of the present invention including spring-loaded, manual pull, power driven and any other kind of cutter capable of cutting flextrim. FIG. 9 shows an embodiment with a manual cutter.

Figure 8:
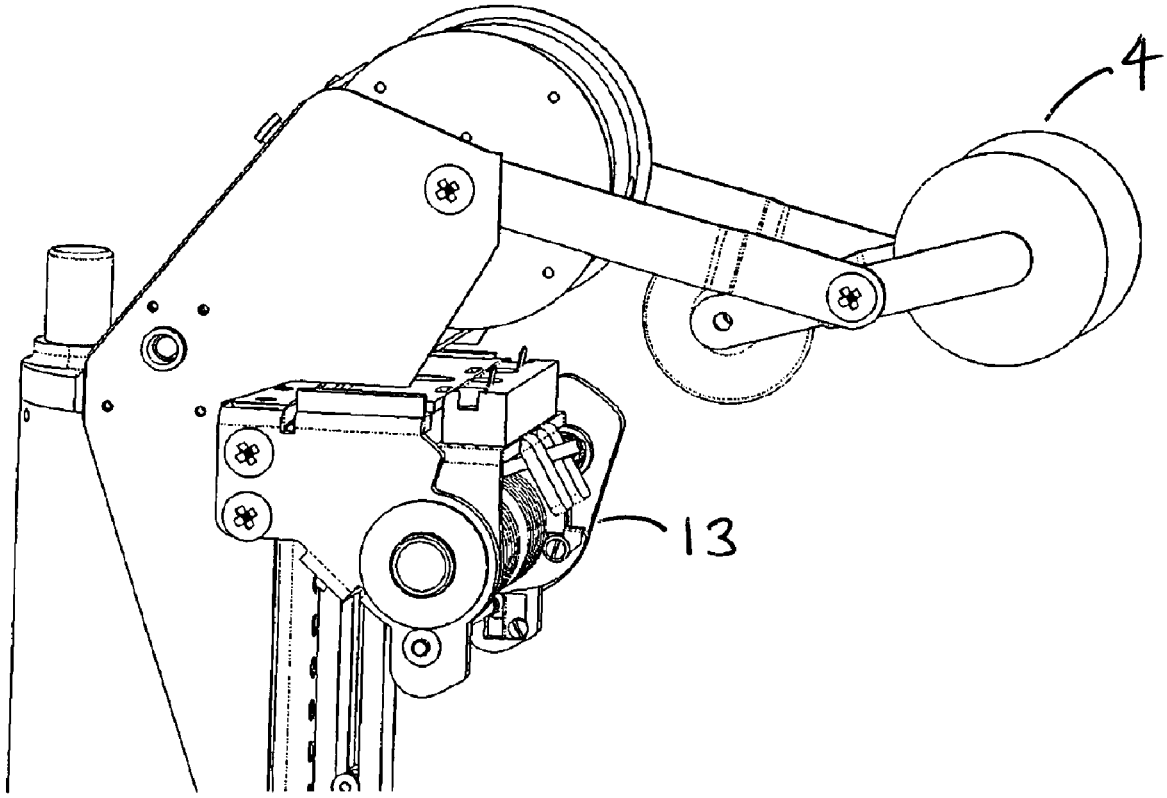
FIG. 8 shows the embodiment of FIG. 7 with the ferris wheel in position for an exterior corner.

FIG. 7 also shows the ferris wheel arrangement with the interior blade wheel 2 in position for use. FIG. 8 shows the embodiment of FIG. 7 with the exterior blade wheel 4 in position for use.

Several descriptions and illustrations have been presented to aid in the understanding of the present invention. A person skilled in the art to which the present invention relates will understand that many changes and variations are possible. All of these changes and variations are within the scope of the present invention. In particular, the present invention can be used to lay down any type of flexible trim on any corner of any angle. Different roller blade wheels and drive wheels can be used and exchanged. These can be removable or fixed. The blades can be made from any material and can be any shape necessary to conform to any type of trim product. The handle assembly can be any length and can contain an inner handle that moves the unit to a different angle or activates a cutter. The unit can be used with or without a cutter, and any type of cutter can be used including powered cutters, spring-loaded cutters, manual cutters and any other cutter that will cut the trim or bead material being used. A cutter can be activated in any possible way including a rod, a trigger, automatically or any other way. The present invention can be made from any rigid material.

We claim:

1. A drywall tool for dispensing flextrim bead for both interior and exterior angles comprising:
   - a base mounting member with an elongated handle;
   - a head member attached to said base mounting member, said head member containing a drive wheel for pulling flextrim product from a roll and feeding it onto a drywall corner seam;
   - a first blade wheel and a second blade wheel also attached to said head member, one of said blade wheels pressing said flextrim product into said seam, said first blade wheel comprising a disk member for an interior seam and said second blade wheel comprising a pair of conical members for an exterior corner.

2. The drywall tool of claim 1 wherein said second blade wheel for an exterior corner comprises a pair of intersecting cones, said cones intersecting along a central axis, said cones aligned with said axis.

3. The drywall tool of claim 1 further comprising a ferris wheel arrangement attached to said head member, said ferris wheel arrangement holding said first blade wheel on a first end and exterior said second blade wheel on a second end, whereby, said ferris wheel arrangement may be used to rotate one of said blade wheels into position for use.

4. The drywall tool of claim 1 further comprising a cutter attached to said head member.

5. The drywall tool of claim 4 wherein said cutter is powered.

6. The drywall tool of claim 4 wherein said cutter is spring-loaded.

7. The drywall tool of claim 4 wherein said cutter is manual.

8. The drywall tool of claim 1 wherein different drive wheels can be used with interior and exterior flextrim product.

9. A drywall tool for dispensing and laying down drywall flextrim product on both interior and exterior corners comprising an elongated handle attached to a head, the head containing a toothed drive wheel for pulling the flextrim product off of a roll and dispensing it, and a pair of roller blades for laying the flextrim product onto the corner, a first roller blade being a disk like a pizza cutter for use on an interior corner and a second roller blade being formed from two intersecting cones for use on an exterior corner.

10. The tool of claim 9 further comprising a cutter attached to the head for cutting the flextrim product.

11. The tool of claim 10 wherein the cutter is powered.

12. The tool of claim 10 wherein the cutter is spring-loaded.

13. The tool of claim 10 wherein the cutter is manual.

14. A tool for dispensing trim material comprising:

a handle;

a drive wheel coupled to said handle for pulling the trim material from a roll;

at least two roller blades coupled to said handle for pressing the trim material into a corner, said roller blades each being adapted to fit a particular type of corner seam.

15. The tool of claim 14 wherein one of said roller blades is a disk like a pizza knife.

16. The tool of claim 14 wherein one of said roller blades has a cylindrical shape of variable diameter with two ends and a center.

17. The tool of claim 16 wherein said roller blade's diameter is maximum at said two ends and minimum at said center.

18. The tool of claim 17 wherein said diameter changes linearly from said center to each of said ends.

19. The tool of claim 14 further comprising a cutter coupled to said handle for cutting said trim material.

20. The tool of claim 19 wherein said cutter is upstream of at least one of said roller blades, and said drive wheel is upstream of said cutter.

* * * * *